US005746176A

United States Patent [19]

Damson et al.

[11] Patent Number: 5,746,176

[45] Date of Patent: May 5, 1998

[54] METHOD AND ARRANGEMENT FOR CONTROLLING AN INTERNAL COMBUSTION ENGINE

[75] Inventors: Eckart Damson, Gerlingen; Martin Klenk, Backnang; Stefan Miller, Waiblingen, all of Germany

[73] Assignee: Robert Bosch GmbH, Stuttgart, Germany

[21] Appl. No.: 737,549

[22] PCT Filed: Apr. 12, 1995

[86] PCT No.: PCT/DE95/00505

§ 371 Date: Nov. 12, 1996

§ 102(e) Date: Nov. 12, 1996

[87] PCT Pub. No.: WO95/31636

PCT Pub. Date: Nov. 23, 1995

[30] Foreign Application Priority Data

May 11, 1994 [DE] Germany ..... 44 16 611.7

[51] Int. Cl.[6] ..... F02D 41/00; F02D 33/00

[52] U.S. Cl. ..... 123/336; 123/399; 123/683; 123/403

[58] Field of Search ..... 123/336, 443, 123/396, 399, 403, 683

[56] References Cited

U.S. PATENT DOCUMENTS

| | | | |
|---|---|---|---|
| 4,616,621 | 10/1986 | Kuroiwa et al. | 123/585 |
| 5,014,668 | 5/1991 | Klenk et al. | 123/399 |
| 5,144,915 | 9/1992 | Grabs et al. | 123/683 |
| 5,381,768 | 1/1995 | Togai et al. | 123/339 |
| 5,456,231 | 10/1995 | Suzuki et al. | 123/399 |
| 5,515,828 | 5/1996 | Cook et al. | 123/683 |
| 5,619,967 | 4/1997 | Streib | 123/399 |
| 5,638,790 | 6/1997 | Minowa et al. | 123/399 |
| 5,645,033 | 7/1997 | Person et al. | 123/399 |

FOREIGN PATENT DOCUMENTS

| | | |
|---|---|---|
| 41 09 561 | 9/1991 | Germany . |
| 41 11 078 | 10/1991 | Germany . |
| 44 18 112 | 12/1994 | Germany . |

OTHER PUBLICATIONS

"Powertrain Control System for Lean Combustion Engines" by Y. Ohyama et al, Hitachi Review, vol. 35 (1986), No. 3, Tokyo, Japan, pp. 141 to 144.

*Primary Examiner*—Thomas N. Moulis
*Attorney, Agent, or Firm*—Walter Ottesen

[57] ABSTRACT

A method and an arrangement for controlling an internal combustion engine is suggested wherein, in at least a first operating range, a lean air/fuel mixture are pregiven and, for a power command from the driver (for example, in transient operating states or in the vicinity of the full load range) a switchover to a stoichiometric mixture takes place; during the transition, the torque change (caused by the change of the air/fuel ratio) is essentially compensated by correspondingly influencing the air supply to the engine.

11 Claims, 4 Drawing Sheets

METHOD AND ARRANGEMENT FOR CONTROLLING AN INTERNAL COMBUSTION ENGINE

BACKGROUND OF THE INVENTION

A method and arrangement for controlling an internal combustion engine is disclosed in U.S. Pat. No. 5,014,668. There, the internal combustion engine is driven in the lower and mid load ranges with an excess of air, that is, with a lean air/fuel mixture ($\lambda>1$). If the accelerator pedal position signal exceeds a pregiven position threshold value in the upper load range, then a throttle flap (that is, the air supply to the engine) is adjusted in such a manner that an essentially stoichiometric mixture ($\lambda=1$) is maintained. With this measure, the advantages of an engine driven with a lean mixture can be used in the part-load range without it being necessary to accept a loss of power in the upper load range. In this way, a reduced toxic-substance emission and a reduced consumption of fuel is obtained. The adjustment of the throttle flap in order to pass from operation with a lean mixture into an operation with a stoichiometric mixture or vice versa is undertaken slowly within a pregiven time span in order to exclude jumps in torque. With this slow transition, high loads of toxic substances can arise in the exhaust gas so that a slow adjustment of the throttle flap in some operating states can have unwanted consequences.

SUMMARY OF THE INVENTION

It is therefore an object of the invention to provide measures according to which the transition from lean operation into the stoichiometric operation and vice versa takes place while reducing the toxic-substance emissions and while avoiding jumps in torque.

In addition, it is a target of the procedure of the invention to indicate under which conditions a change of the type of operation appears suitable, that is, for example, in which operating state the one or other mode of operation is to be selected and on the basis of which signals or signal traces the transition is to be detected.

Furthermore, in the known state of the art, the control of the throttle flap is undertaken in all operating ranges via an electrical path, that is, a so-called electronic accelerator pedal system is utilized. Such a control system is very extensive so that the complexity and the cost to realize the control of the engine can be considerable.

According to a further aspect of the invention, a control system is therefore provided for an internal combustion engine for a lean operation in first operating states and a stoichiometric operation in second operating states which is less complex and nonetheless exhibits an adequate influence on the supply of air to the engine for a satisfactory transition from the lean region into the stoichiometric region.

DE 4,111,078 A1 provides, for traction control, a second throttle flap which is electrically actuable from its fully open position to its closed position. This is in addition to the main throttle flap in the intake system of the engine which is actuable by the driver via a mechanical path. The second throttle flap is, as a rule, in the fully open position and is actuated in the closing direction to reduce the power of the engine when there is slippage at the drive wheels.

With the procedure of the invention, a control system for an internal combustion engine is provided wherein a transition from a mode of operation with a lean mixture composition in first operating states to a mode of operation with a stoichiometric mixture composition in second operating states is ensured without a jump in torque and increased emissions of toxic substances.

It is especially advantageous that, with the procedure of the invention, an operation of the internal combustion engine with a lean mixture composition is possible in large load ranges. It is further advantageous that, at increased power requirement (for example, in the acceleration phase, during transient operation or in the upper load range of the engine), a comfortable rapid switchover to a stoichiometric mixture composition takes place; whereas, for reduced power requirement, a corresponding transition into the mode of operation with a lean mixture takes place.

Furthermore, and in an advantageous manner, a possibility is provided to intervene in the air supply to realize the procedure according to the invention which can be provided without great complexity and which influences the air supply to the engine to a sufficient extent to realize the transition.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
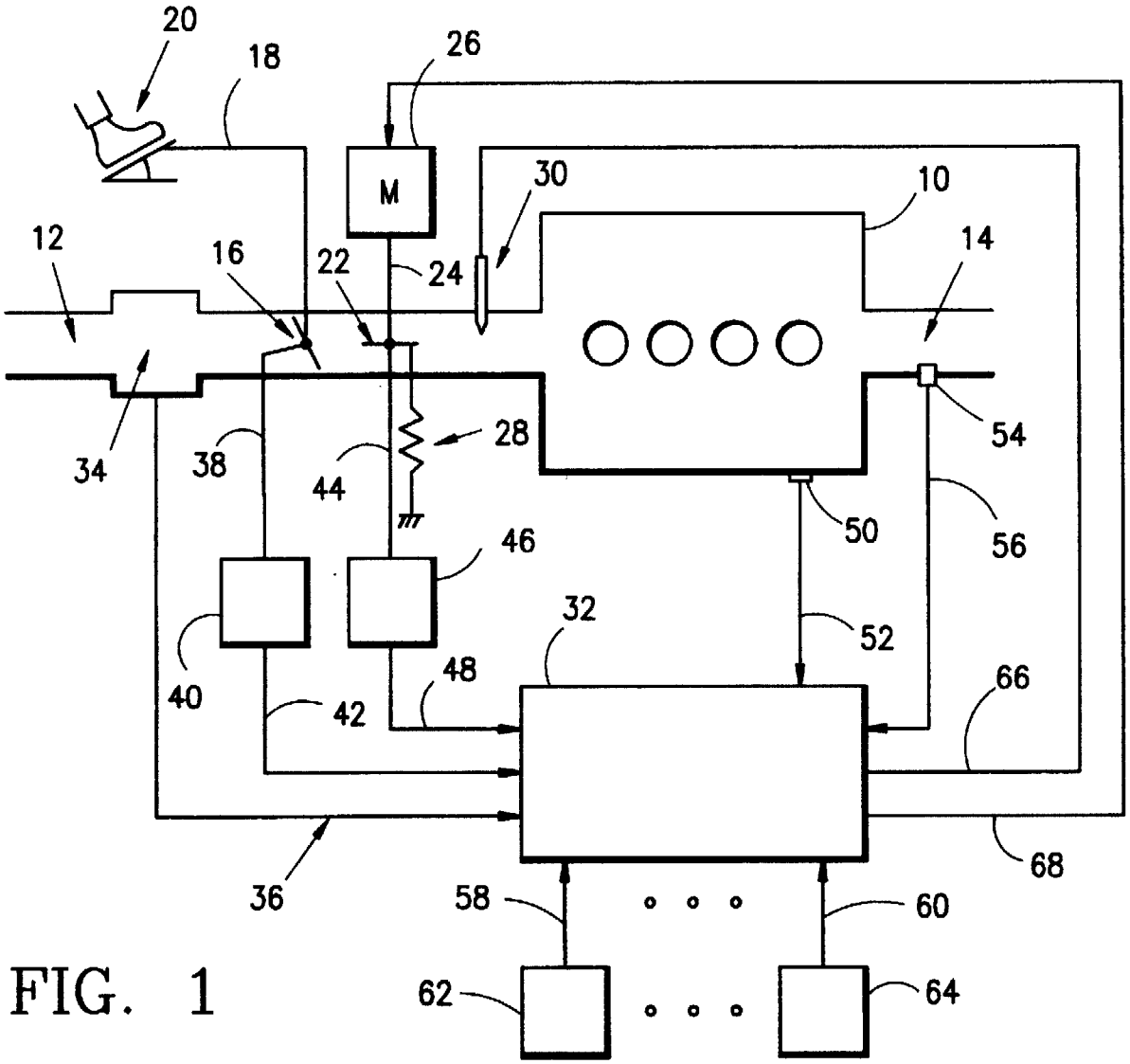
FIG. 1 is an overview block circuit diagram of a control for an internal combustion engine wherein the procedure of the invention is realized.

In FIG. 1, a preferred embodiment of a control arrangement for an internal combustion engine is shown wherein the procedure of the invention is realized. The engine 10 includes an air intake system 12 and an exhaust-gas system 14. A first throttle flap 16 is mounted in the air intake system 12 and is connected via a mechanical connection 18 to an operator-controlled element 20 actuated by the driver, namely, an accelerator pedal. The accelerator pedal 20 or the throttle flap itself is biased against its rest position by means of a spring in a manner known per se. In addition, a second throttle flap 22 is mounted in the intake system. The second throttle flap 22 is connected via a mechanical connection 24 to an electric motor 26. The throttle flap 22 is biased into its fully open position via a spring 28. Furthermore, one or several injection valves 30 for metering fuel are provided. A control unit 32 receives a measure for the air supply to the engine from a sensor 34 (air quantity sensor, air mass sensor, pressure sensor or throttle flap position sensor). The sensor 34 specifies the air supply to the engine. The throttle flap 16 is connected via a mechanical connection 38 to a position sensor 40 for detecting the position of the throttle flap 16. The output line 42 of the position sensor 40 leads to the control unit 32. The throttle flap 22 is also connected via a mechanical connection 44 to a throttle flap position sensor 46 having output line 48 leading to the control unit 32. The position sensors are potentiometers in the preferred embodiment. Furthermore, the internal combustion engine includes a rpm sensor 50 which is connected via a line 52 to the control unit 32. In the exhaust-gas system 14 of the engine, at least one exhaust-gas sensor 54 is provided which is connected via a line 56 to the control unit 32. Furthermore, the control unit 32 has further input lines 58 to 60 which connect the control unit 32 to measuring devices 62 to 64, respectively, for further operating variables of the engine and/or vehicle. The control unit 32 has the line 66 as an output line. This output line connects the control unit to at least one injection valve 30 for controlling the metering of fuel. Furthermore, an output line 68 is provided which leads to the electric motor 26 for actuating the throttle flap 22. In addition to influencing the metering of fuel and the throttle flap 22, an influencing of the ignition angle (not shown for reasons of clarity) as well as a control of the idle position of the throttle flap 16 is provided as required.

The above-described electrically actuable ancillary flap is in addition to the mechanically actuable main throttle flap. In addition to this ancillary flap, and in another advantageous embodiment (not shown for reasons of clarity), a so-called electronic accelerator pedal system is provided wherein a single throttle flap is electrically adjusted in dependence upon the position of the accelerator pedal. The throttle flap 16 is connected via a mechanical connection to an electrical position motor which is actuated by the control unit 32 via a drive line. A signal for positioning the throttle flap is supplied to the control unit 32 via the position transducer 40 and the line 42. The elements 68, 26, 24, 22, 28, 44, 46, 48 of FIG. 1 can then be omitted.

In addition to the ancillary throttle flap or the electrical main throttle flap, in other advantageous embodiments individual throttle flaps are provided which influence the air supply to individual cylinders or throttle flaps can be provided for so-called channel cutoff which influences the air supply to a pregiven number of cylinders. In addition to the electrical actuation of the throttle flap, other embodiments have been shown to be advantageous wherein the throttle flaps are actuated via a hydraulic or pneumatic path.

The control unit 32 forms a load signal from a characteristic field in a manner known per se in dependence upon the engine rpm supplied via the line 52 and the air mass supplied via the line 36. The load signal is corrected at least by an exhaust-gas control and defines the injection pulse for the injection valve 30. The injection pulse is outputted via the line 66. The exhaust-gas control is a λ-control. An exhaust-gas probe 54 is utilized which outputs a signal, which can be evaluated up to λ=1.6. This signal is outputted not only in the stoichiometric range but also in the lean range. Preferably, the exhaust-gas probe 54 essentially exhibits a linear characteristic. The fuel metering system is then adjusted in such a manner that the engine is operated with an excess of air at least in the lower and mid part-load range. With this operation, λ preferably has a value in the region of 1.5. During transient operation, when the driver accelerates (that is, in the upper part-load range or full load range, when the power demand on the engine is high), a switchover is made from the lean operation to an operation having a stoichiometric mixture (λ=1). The change of the mode of operation takes place in accordance with the procedure of the invention in that the fuel injection quantity is maintained constant, the exhaust-gas control is switched over from the desired value λm in the lean range to the desired value λ1 or vice versa and the torque change resulting therefrom is compensated by a jump-like influencing of the air supply or a jump-like adjustment of the throttle flap 16 or 22 depending upon the embodiment.

Figure 2:
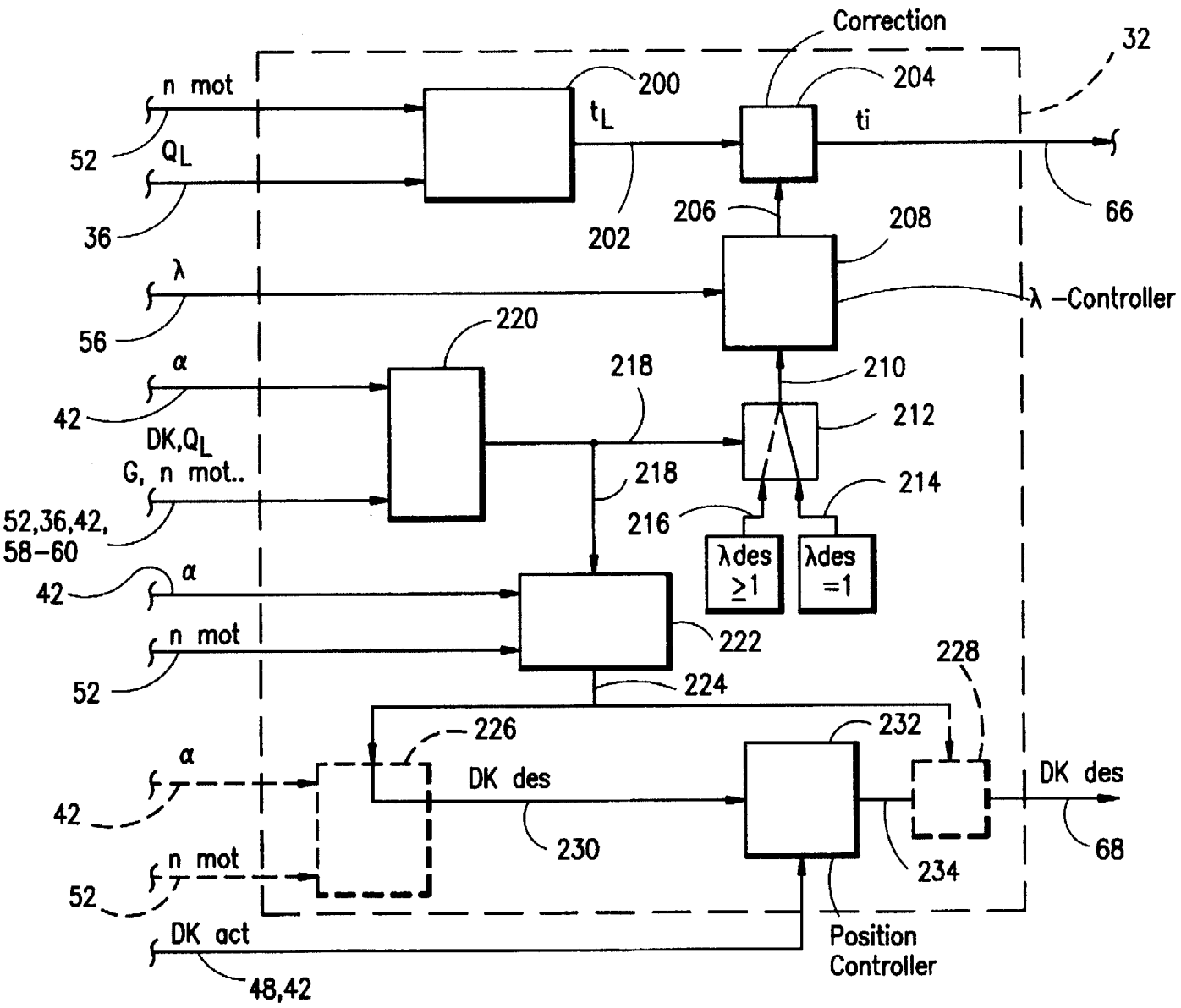
FIG. 2 shows an overview block circuit diagram of the control unit for realizing the procedure of the invention.

FIG. 2 shows a realization of the control unit 32 for carrying out the described procedure. The reference numerals described with respect to FIG. 1 are used. The control unit 32 includes a first computing unit or a first characteristic field 200 to which the lines 52 and 36 are led. The output line 202 of the unit 200 leads to a correction stage 204 having an output line defined by line 66. The correction stage 204 is connected via a line 206 to a λ-controller 208 to which an actual signal is supplied via the line 56 and a desired signal is supplied via line 210. The line 210 leads from a switch element 212 to which the desired value λ1 is supplied via line 214 and a desired value λ>1 is supplied via the line 216. The switch element 212 is switched via a line 218. The line 218 is the output line of a computing unit or a characteristic field 220. In the preferred embodiment, the line 42 (driver command) as well as the lines 52, 36 as well as 58 to 60 are connected to characteristic field 220. The output line 218 leads to a further computing unit (that is, a further characteristic field 222) to which the lines 42 and 52 are connected. The output line 224 of the unit 222 leads to a computing unit or a characteristic field 226 or, alternatively, to a correction stage 228. The lines 42 and 52 lead to characteristic field 226. The output line 230 of characteristic field 226 leads to a position controller 232. In addition, the line 48 leads to the position controller 232 as does the line 42 when utilizing an electronic accelerator pedal system. The output line 234 of the position controller 232 leads, as required, via the correction stage 228 to the output line 68.

In the characteristic field 200, the control unit 32 forms a basic load signal $t_L$ which is outputted via line 202 to the correction stage 204. The base load signal $t_L$ is formed in dependence upon the engine rpm (line 52) and the signal for the air mass, air quantity, intake pipe pressure or the throttle flap position. This signal is supplied via the line 36. The correction stage 204 serves to correct the load signal or the base injection signal $t_L$ in dependence upon the output signal of the λ-controller 208. The λ-controller compares the actual value signal of the exhaust-gas probe 54 with the preadjusted desired value. In the preferred embodiment, the exhaust-gas probe 54 exhibits an essentially linear characteristic line and, in other embodiments, the exhaust-gas probe 54 exhibits a relationship between the exhaust-gas composition and its output signal. This relationship can be evaluated over the desired range. In accordance with a pregiven control strategy (for example, proportional-integral) and together with a precontrol dependent, for example, upon the desired value, the controller 208 outputs an output signal on the line 206 which corrects the base injection signal $t_L$ in the sense of an approximation of the actual value to the desired value. The corrected signal forms the injection signal ti and is outputted via line 66 to the one or more injection valves.

In at least the steady-state or quasi-transient operation in the lower and mid part-load ranges, the λ-controller 208 is supplied with a desired value via the lines 216 and 210 because of a corresponding position of the switch element 212. This desired value corresponds to a lean air/fuel mixture. In the preferred embodiment, this desired value is 1.5. For transient operating states, such as accelerations or decelerations (during significant power requirements such as in or near the full-load range), the desired value of the λ-controller is set to 1 by switching over the switch element 212. This improves the driving performance and a stoichiometric ratio between air and fuel mass results.

The switchover is triggered by the computing unit 220. This unit evaluates the following: accelerator pedal position and, if required, also the throttle flap position; the load signal; the transmission position and/or the engine rpm. This evaluation is made in order to detect a power command of the driver and derive therefrom the necessity for a switchover of the λ-controller. This takes place in the simplest case by inputting a threshold value for the accelerator pedal position in the vicinity of the full load range (for example, at a 70° accelerator pedal position). A switchover to stoichiometric operation takes place when this threshold value is exceeded.

The consideration of transmission position and engine rpm or of the load signal in combination with the accelerator pedal position or throttle flap position is likewise advantageous in that a command for a high engine torque is detected. Furthermore, the computing unit 220 can determine and evaluate the time-dependent derivative of the accelerator pedal position in order to detect transient operations. If the time-dependent derivative exceeds a pregiven limit value (that is, is the accelerator pedal actuated very rapidly in the direction of acceleration), then this is an indication to switch over to stoichiometric operation.

The switchover from stoichiometric operation to lean operation takes place with opposite signs. If the accelerator pedal position drops, for example, below the pregiven threshold value, then there is a switch back to lean operation; likewise, when a detection is made based on the above-mentioned parameters that only a slight torque is requested of the engine or when the time-dependent derivative of the accelerator pedal position drops below the threshold value after a certain time has elapsed since the time point when this threshold value was exceeded.

The switch element 212 is actuated when the computation unit 220 detects a power command of the driver. The desired value of the λ-controller is accordingly changed in a jump-like manner; whereas, the injection quantity is at first unaffected. In conventional systems, such a change of the λ desired value because of a corresponding correction of the injection time leads to a change in torque of the engine which is not wanted. For this reason, the switchover signal on the line 218 is supplied to the switch element 212 as well as to the characteristic field 222. Because of the switchover signal, the characteristic field 222 is activated and determines a throttle flap position on the basis of the instantaneously present accelerator pedal position and the engine rpm in correspondence to the direction of the switchover. The throttle flap position is outputted via the lines 224 and 230 to the position controller which positions the ancillary flap based on the throttle flap position value. In the position controller 232, the desired value is compared to the actual value of the throttle flap position and an output signal is generated which adjusts the position of the ancillary throttle flap in the sense of a control to the desired value.

For a switchover from lean operation to the stoichiometric operation, this means a displacement of the throttle flap from its completely open position to a specific throttle flap angle; whereas, in the reverse situation, the throttle flap is shifted into its completely open position.

The extent of the adjustment of the throttle flap is then determined in such a manner that a torque change of the engine takes place because of the throttle flap adjustment. This torque change compensates essentially the torque change caused by the switchover of the λ-controller. This is achieved via the characteristic field 222 wherein corresponding experimentally determined values are stored for the extent of the adjustment of the throttle flap for each operating point (determined via throttle flap position and engine rpm). For this purpose, for each operating point or for individual support points, the change of the torque, which is generated by a specific adjustment of the throttle flap, is determined. When, for the λ control, only a switchover between two fixed pregiven desired values is used for both modes of operation, the determination of the required throttle flap adjustment to compensate for the torque change because of the switchover is sufficient for each operating point. For changing desired values, the determination for each possible desired value jump or for individual support positions of desired value jumps has to be carried out. The results are then entered into the characteristic field 222 in which the amounts for the throttle flap adjustment via accelerator pedal position and engine rpm are plotted as required as a function of the λ change.

In order to provide a torque compensation when switching over from the stoichiometric operation into the lean operation, the ancillary throttle flap is adjusted in stoichiometric operation in dependence upon the accelerator pedal position and the engine rpm as well as, if required, in dependence upon the λ value to be adjusted in lean operation via the characteristic field 222 in such a manner that the torque change of a switchover (which occurs at any desired time point) is compensated by adjusting the throttle flap in a position which is further open.

If an electronic accelerator pedal system is used, a characteristic field 226 is provided which, in lean operation, determines a throttle flap position on the basis of accelerator pedal position and, if required, on the basis of engine rpm. The position controller 232 then controls the throttle flap position over the entire operating range in such a manner that the actual throttle flap position corresponds to the desired value. In an embodiment of this kind, a switchover to the characteristic field 222 takes place in stoichiometric operation to control the throttle flap. This characteristic field 222 is fixed with respect to the characteristic field 226 in such a manner that the differences in the read out throttle flap positions compensate the torque change generated by the λ switchover.

In another advantageous embodiment, the characteristic field 226 is not controlled by the characteristic field 222; instead, the characteristic field values of the characteristic field 226 are corrected additively, multiplicatively or in another manner via the values read out from the characteristic field 222.

Furthermore, in a further advantageous embodiment, and proceeding from characteristic field 222, the throttle flap is adjusted directly via the correction stage 228 independently of the position controller in the context of an open control. Here, the values read out of the characteristic field 222 either form corrective values for the controller output signal or replace this signal.

The embodiment described above switches between two fixed desired values of λ. In other embodiments, it can be advantageous to change the desired value in the lean range because of toxic-substance emissions. In this case, the actual λ desired value is inputted into the characteristic field 222 before and after the switchover so that a measure for the throttle flap position change and therefore a measure for the torque compensation can be obtained based on accelerator pedal position and engine rpm.

Figure 3A:
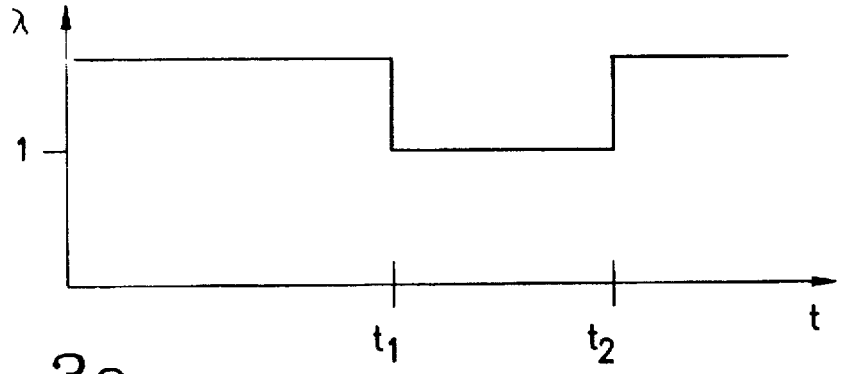
FIGS. 3*a* to 3*d* show respective operating parameters plotted as a function of time for an exemplary operating situation.
Figure 3B:
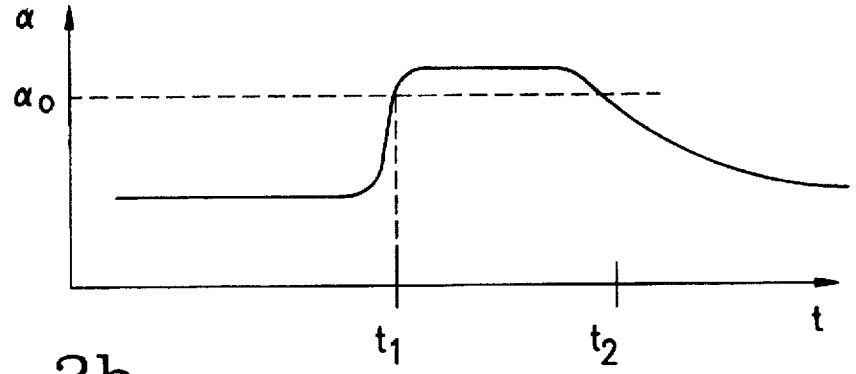
Figure 3C:
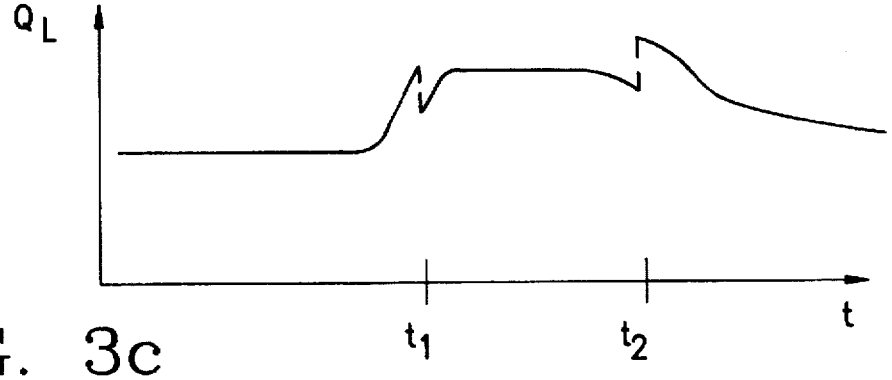
Figure 3D:
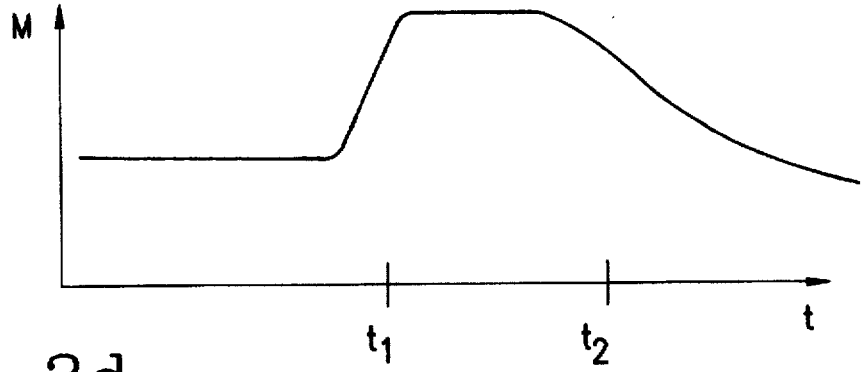

In FIGS. 3*a* to 3*d*, typical signal traces are shown for an exemplary operating situation. Time is plotted along the horizontal in each of FIGS. 3*a* to 3*d*. In FIG. 3*a*, the λ value is plotted along the vertical axis; in FIG. 3*b*, the accelerator position α is plotted and the air supply $Q_L$ is plotted in FIG. 3*c*. In FIG. 3*d*, the torque M of the engine is plotted also as a function of time.

Up to time point $t_1$, the engine runs in the lean range. A switchover from the lean setting to the stoichiometric setting takes place when a pregiven accelerator pedal threshold $\alpha_0$ is exceeded. According to FIG. 3*a*, this leads to a change of the λ value and, in accordance with FIG. 3*c*, to a jump-like reduction of the air supply $Q_L$. The torque amounts of the λ change and the change of the air supply are so selected that they essentially compensate each other. For this reason, no torque change can be seen in FIG. 3*d* at time point $t_1$. At time point $t_2$, the accelerator pedal position drops below the threshold value. This leads to a switchover from the stoichiometric setting into the lean setting which leads to a jump-like change of the λ desired value at time point $t_2$ and to a jump-like increase of the air supply $Q_L$ at time point $t_2$ as shown in FIGS. 3*a* and 3*c*. Here too, the torque amounts of both changes compensate each other so that for the course of the torque in accordance with FIG. 3*d*, no or only very slight torque changes are detected. The injection time ti remains unchanged during the transitions because, as a consequence of the time constant of the λ control, the adaptation of the exhaust-gas composition to the change of the desired value is undertaken via changes of the air supply (that is, by the jump of the throttle flap). In this way, the λ control controls only small changes when the desired value changes.

Figure 4:
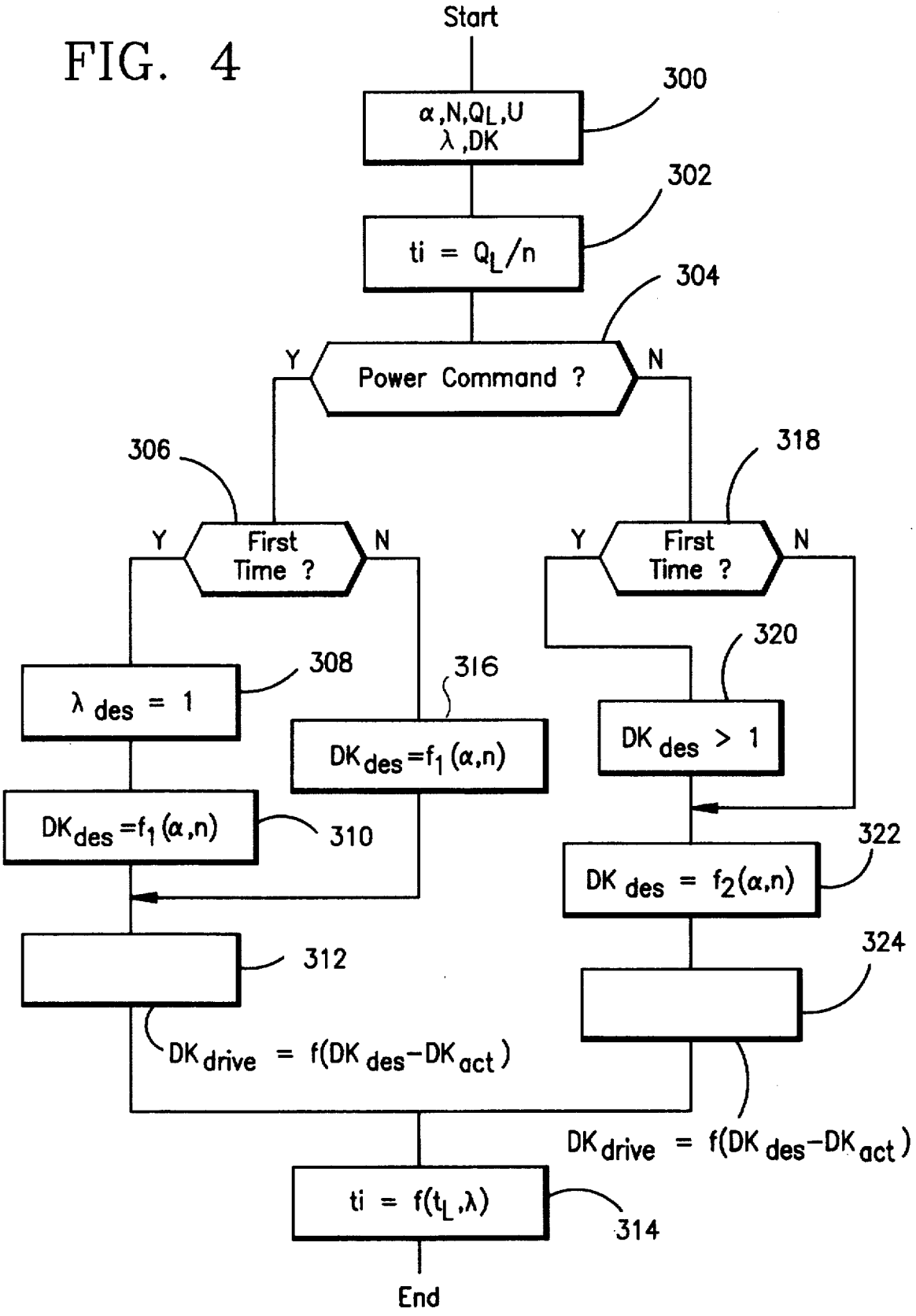
FIG. 4 shows a flowchart as an example realizing the procedure of the invention as a computer program.

In FIG. 4, a flowchart in the form of a computer program is shown as a realization of the procedure of the invention. After the start of the subprogram, and in a first step 300, the following relevant operating variables are read in: accelerator pedal position α, engine rpm n, air supply $Q_L$, transmission ratio U, lambda value λ as well as throttle flap position DK. And, in the next step 302, the base injection time ti is determined by forming a quotient of the air supply and the engine rpm. Inquiry step 304 then follows.

In this inquiry step, a determination is made as to whether a power request of the driver is present. This takes place, for example, by a comparison of the accelerator pedal position to a pregiven threshold value, by evaluating the time-dependent derivative of the accelerator pedal position, by combined evaluation of accelerator pedal position, engine rpm, engine load and/or transmission ratio, in order to determine an increased torque demand on the engine.

If a power command is detected, then in the following inquiry step 306, a check is made as to whether this power command occurred for the first time. If the power command occurred for the first time, then, in step 308, the λ desired value is set to 1 and, in the next step 310, the desired set value of the throttle flap is determined in accordance with a first characteristic field from accelerator position and engine rpm. This characteristic field is selected in such a manner that, for a transition from λ>1 to λ=1, the occurring torque jump is precisely compensated by the corresponding adjustment of the throttle flap and the reduction of the air supply. If the throttle flap desired value is determined in accordance with step 310, then, in step 312, the throttle flap drive signal is determined by the position controller on the basis of the difference between desired and actual values. In the next step 314, the injection time ti is determined on the basis of the base injection time $t_L$ and the output of the λ-controller.

If, in step 306, it is detected that the power command has already been detected in a previous program passthrough, then, in step 316, the throttle flap desired value is determined on the basis of accelerator pedal position and engine rpm in accordance with the first characteristic field and the program continues with steps 312 and 314.

If no request for power is detected, then a check is made in step 318 as to whether this is the case for the first time. If this is the case, then in step 320, the λ desired value is set to a value>1 and, in the next step 322, the throttle flap desired value is determined in accordance with a second characteristic field on the basis of accelerator pedal position and engine rpm. Here too, the torque change, which is to be expected because of the change of desired value of the λ-controller, is compensated by a corresponding configuration of the second characteristic field in step 322. After step 322, step 324 follows and the throttle flap drive signal is computed by the position controller. If, in step 318, it is detected that no power command is detected at least in the pregiven program passthrough, the program continues directly with step 322. The subprogram is ended after step 314 and repeated at a pregiven time.

FIGS. 3*a* to 3*d* and 4 were explained on the basis of a so-called EGAS system. If an ancillary flap is used in accordance with FIG. 1, then the second characteristic field in the right branch of the flowchart of FIG. 4 is omitted. In lieu of this characteristic field, the drive for the ancillary flap is switched off whereby the throttle flap is shifted into the fully open position under the action of the return spring. A corresponding procedure is carried out for individual throttle flaps or for throttle flaps for switching off a channel.

We claim:

1. A method for controlling an internal combustion engine having at least one electrically actuable adjusting element for controlling the air supply to the engine, the method comprising the steps of:

controlling the metering of fuel to the engine in accordance with operating state present so that at least in a first operating range an adjustment is made to provide a lean air/fuel ratio and in at least a second operating range an adjustment is made to provide a stoichiometric ratio;

switching between said operating ranges pursuant to at least one of the following:

(a) in dependence upon the time-dependent derivative of the accelerator pedal position;

(b) in dependence upon the accelerator pedal position; and, (c) because of increased torque requirement determined in dependence upon at least one of the following:

(i) accelerator pedal position;

(ii) engine rpm;

(iii) engine load; and, (iv) transmission ratio;

and effecting said switching at least by acting upon said adjusting element for controlling the air supply to said engine;

setting said adjusting element in accordance with an input value derived in dependence upon a driver command and by taking into account a pregiven air/fuel ratio;

forming said input value in dependence upon said accelerator pedal position and said engine rpm;

changing said dependence when there is a change of the pregiven air/fuel ratio so that the torque outputted by said engine before and after the switchover between said operating regions is essentially the same; and, shifting said adjusting element in a jump-like manner.

2. The method of claim 1, wherein said adjusting element is shifted with a single jump.

3. The method of claim 1, wherein said engine has a λ-controller for controlling the air/fuel ratio; and, wherein the method further comprises the step of changing the desired value of said λ-controller from a value providing a lean mixture composition to a value providing a stoichiometric composition when the switchover occurs from said first operating range having the lean air/fuel ratio to said second operating range having the stoichiometric ratio.

4. The method of claim 1, wherein said adjusting element is an ancillary flap in the main channel of the air intake system or is assigned to individual ones or groups of cylinders and, in lean operation, is in the fully open position and, in stoichiometric operation, is adjusted in the direction of closing.

5. The method of claim 1, further comprising the steps of setting said adjusting element during stoichiometric operation in accordance with a first characteristic field and setting said adjusting element in lean operation in accordance with a second characteristic field at least in dependence upon said accelerator pedal position.

6. The method of claim 1, wherein the adjusting element is adjusted in the context of a position control.

7. The method of claim 1, wherein an exhaust-gas probe having a linear characteristic line is utilized for λ control.

8. The method of claim 1, wherein the jump-like adjustment of the desired value of the λ control and of the adjusting element for adjusting the air supply to the engine take place simultaneously.

9. An arrangement for controlling an internal combustion engine having at least one electrically actuable adjusting element for controlling the air supply to the engine, the arrangement comprising:

means for controlling the metering of fuel to the engine in accordance with operating state present so that at least in a first operating range an adjustment is made to provide a lean air/fuel ratio and in at least a second operating range an adjustment is made to provide a stoichiometric ratio;

means for switching between said operating ranges pursuant to at least one of the following:

(a) in dependence upon the time-dependent derivative of the accelerator pedal position;

(b) in dependence upon the accelerator pedal position; and, (c) because of increased torque requirement determined in dependence upon at least one of the following:

(i) accelerator pedal position;

(ii) engine rpm;

(iii) engine load; and, (iv) transmission ratio;

and effecting said switching at least by acting upon said adjusting element for controlling the air supply to said engine;

means for setting said adjusting element in accordance with an input value derived in dependence upon a driver command and an input value derived by taking into account a pregiven air/fuel ratio;

derivation means for deriving said input value for said adjusting element;

said derivation means being configured so that said input value is dependent upon said accelerator pedal position and said engine rpm and so that, when there is a change of the pregiven air/fuel ratio, the dependency upon said accelerator pedal position and said engine rpm is changed so that the torque outputted by said engine before and after the switchover between said operating ranges is essentially the same; and, means for shifting said adjusting element in a jump-like manner.

10. The arrangement of claim 9, wherein said adjusting element is shifted with a single jump.

11. The arrangement of claim 9, wherein said adjusting element is a first element for controlling the air supply to the engine and said first adjusting element being adjustable mechanically by the driver; and, said arrangement further comprising a second element for controlling the air supply to the engine and said second adjusting element being actuated in at least one of the following ways: electrically, pneumatically and hydraulically; and, said second adjusting element being mounted in series with said first adjusting element in the air intake system of said engine.

* * * * *